United States Patent [19]

Stoudt

[11] 4,264,183

[45] Apr. 28, 1981

[54] DUPLEX COPYING APPARATUS AND METHOD

[75] Inventor: Michael D. Stoudt, Webster, N.Y.

[73] Assignee: Eastman Kodak Company, Rochester, N.Y.

[21] Appl. No.: 45,556

[22] Filed: Jun. 4, 1979

[51] Int. Cl.[3] ..... G03G 15/00

[52] U.S. Cl. ..... 355/3 R; 355/3 SH; 355/24; 430/31; 430/54

[58] Field of Search ..... 355/3 R, 3 SH, 3 TR, 355/14 SH, 14 TR, 24, 25, 26, 77; 430/31, 54

[56] References Cited

U.S. PATENT DOCUMENTS

| | | | |
|---|---|---|---|
| 3,637,306 | 1/1972 | Cooper | 355/15 |
| 3,672,765 | 6/1972 | Altmann | 355/24 |
| 3,947,270 | 3/1976 | North | 355/3 R X |
| 4,035,073 | 7/1977 | Del Vecchio | 355/24 |
| 4,140,386 | 2/1979 | Satomi | 355/14 |

*Primary Examiner*—Fred L. Braun

*Attorney, Agent, or Firm*—John D. Husser

[57] ABSTRACT

The duplex copying of two-sided originals onto two sides of a copy sheet is accomplished by interspersing images from two successive documents on a multi-image imaging member, specifically with the front-side image of a second document interspersed between the front and rear-side images of a first document. Copy sheet turnover can thus occur during the transfer of the front-side of the second document to achieve an increased "copy-output-rate to electrographic-procedure-speed" ratio.

8 Claims, 5 Drawing Figures

FIG. 1
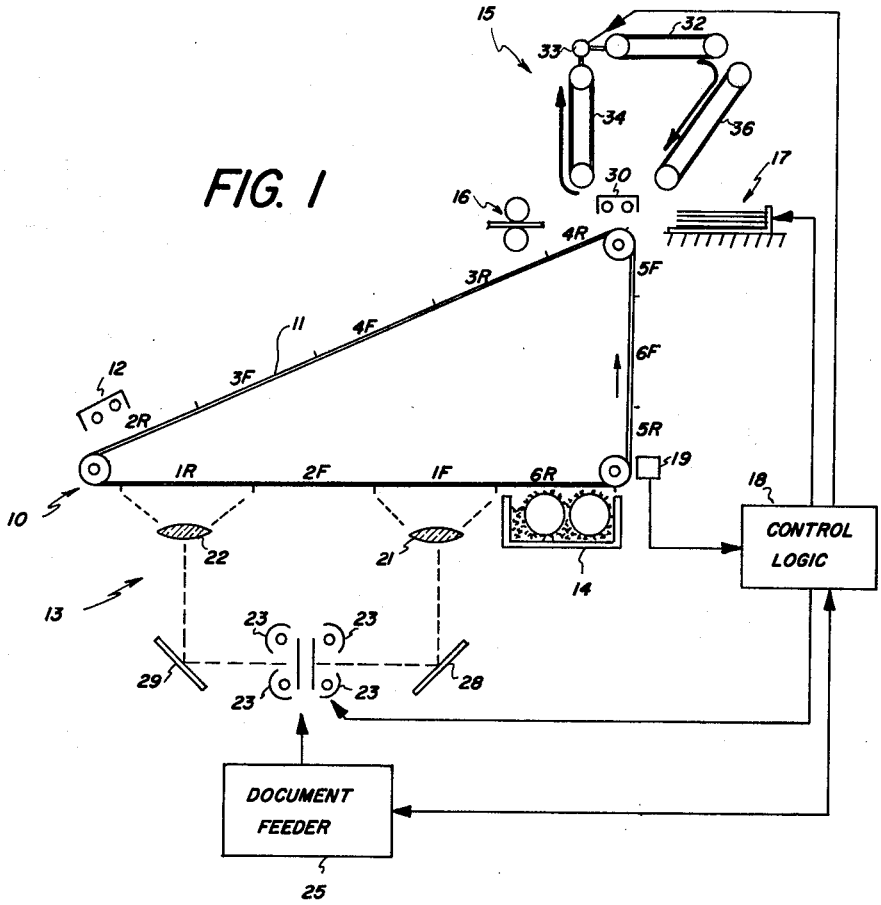
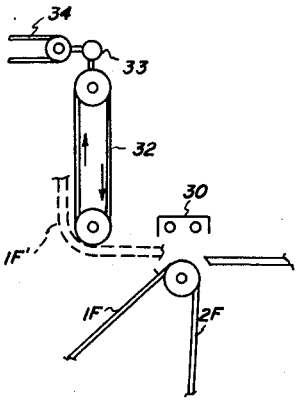
FIG. 3a
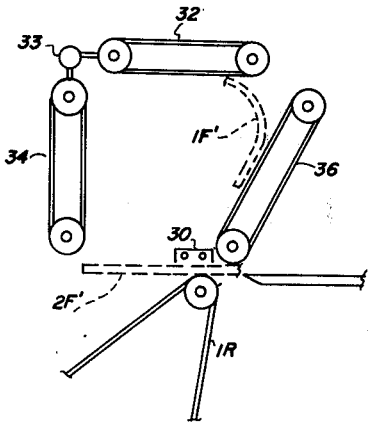
FIG. 3c

DUPLEX COPYING APPARATUS AND METHOD

BACKGROUND OF THE INVENTION

1. Field of the Invention

The present invention relates to electrographic reproduction apparatus and method and more particularly to an improved approach for duplex reproduction (i.e., the forming of images on both sides of a copy sheet).

2. Description of the Prior Art

Electrographic copying is currently a highly preferred technique for document reporduction. However, until recently most electrographic copying apparatus did not utilize both sides of a copy sheet, i.e., formed images only on one side. As is apparent this was wasteful, both of the copy paper and the storage space required to accommodate reproduced documents. Additionally, this characteristic caused inconvenience when copying originals which had information on both sides as do most printed publications. For example, the operator must manually turn over the original to copy the other side. In simplex (one-sided) copying of multipage, two-sided originals complications evolve in maintaining the proper page sequence.

To obviate the disadvantages of simplex copying, various approaches have been developed, two somewhat straightforward approaches being the first suggested. One of those provides two complete electrophotographic systems which operate concurrently and respectively form images on opposite copy sheet sides. Another feeds a series of duplex originals and copy sheets past the copy station in first and second passes with the operator turning both stacks over between passes. Both techniques have obvious disadvantages, the two-machine approach being extremely costly in hardware and the two-pass technique being time consuming and requiring operator interplay.

Thus, more sophisticated approaches have evolved. For example, in one such approach both sides of a duplex original are concurrently exposed onto succesive image areas of the photoconductor. The developed toner image of the first document side is transferred to a drum adjacent the photoconductor path and then transferred to one side of a copy sheet during transfer of the subsequent toner image from the photoconductor to the other side of the copy sheet. This approach obviates the disadvantages outlined above; however, the concurrent electrostatic transfer of two toner images to opposite sides of a copy sheet presents a difficult procedural step to perform reliably with high quality.

Another approach disclosed in U.S. Pat. No. 3,672,765 likewise provides for concurrent exposure of the two sides of the duplex document onto successive image areas of a photoconductor. However, instead of effecting a simultaneous transfer of the two developed images to the copy sheet, this technique utilizes sequential transfers with an intervening turnover of the copy sheet. While this approach avoids the difficult electrostatic transfer problems, it introduces a constraint on machine copying rate. Specifically, a time interval must be allowed, between successive transfers of the duplex original images, for the mechanical-turnover of the copy sheet. In addition, two transfer stations are utilized.

SUMMARY OF THE INVENTION

It is an object of the present invention to provide a new and improved approach to duplex copying which avoids the disadvantages of prior techniques. More specifically it is an object to provide improved duplex copying apparatus and technique which allows sequential transfer of the two duplex original images to the opposite sides of a copy sheet but does not require multiple transfer stations or necessitate a loss in copy output.

In general the present invention achieves such objectives by: (1) interspersing between the front and back electrostatic images of a first original the electrostatic image of the front side of the next successive original and (2) effecting turnover of the copy sheet for the first original while the front side image of the next successive original is being transferred to a subsequent copy sheet. This approach thus allows an increase in what can be termed the "copy-output-rate to electrographic-procedure-rate" ratio. That is, to match the copy output rate of apparatus according to the present invention, the prior art approach for sequential transfer must provide an increase in speed for the photoconductor (and the electrographic operations performed thereon) by an extent which compensates for the loss of time expended in turnover during each copying operation. Increasing the rate of electrographic procedures is not a trivial matter, as charging, exposure, development, transfer, cleaning and paper handling are all increased as technical problems in proportion to increases in the rate at which they are performed.

BRIEF DESCRIPTION OF THE DRAWINGS

The subsequent description of preferred embodiments is set forth with reference to the attached drawings which form a part hereof and in which:

FIG. 1 is a schematic view of one embodiment of electrographic apparatus incorporating the present invention;

DETAILED DESCRIPTION OF THE PREFERRED EMBODIMENTS

Figure 3B:
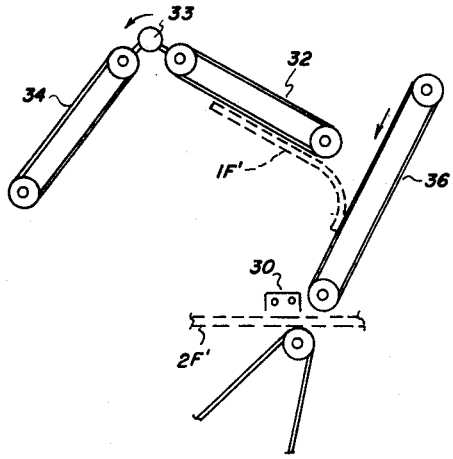

The electrophotographic apparatus 10 shown in FIG. 1 comprises an endless image member 11 of a conventional construction, e.g., a film belt having an intermediate conductive layer and a layer of organic photoconductor on the imaging surface. The usual operative stations are provided around the path of belt travel, e.g., a primary charging station 12, an exposure station 13, a development station 14, a transfer station 15 and a fusing station 16. These stations function generally in the usual manner, i.e., forming a primary charge on the photoconductor at station 12, imagewise discharging to form a latent electrostatic image at station 13, applying toner to develop that image at station 14, transferring the toner image to a copy sheet from supply 17 at transfer station 15 and fusing the toner to the copy sheet at fusing station 16. Machine control logic 18 synchronizes the various electrographic operations in proper timed relation with each image area on the belt 11, e.g., by detecting timing marks on the belt with sensor 19. Various structures and modes for effecting the operations thus far discussed are well known and in addition certain other known operations such as photoconductor cleaning and erase (not shown) are normally performed.

Figure 2:
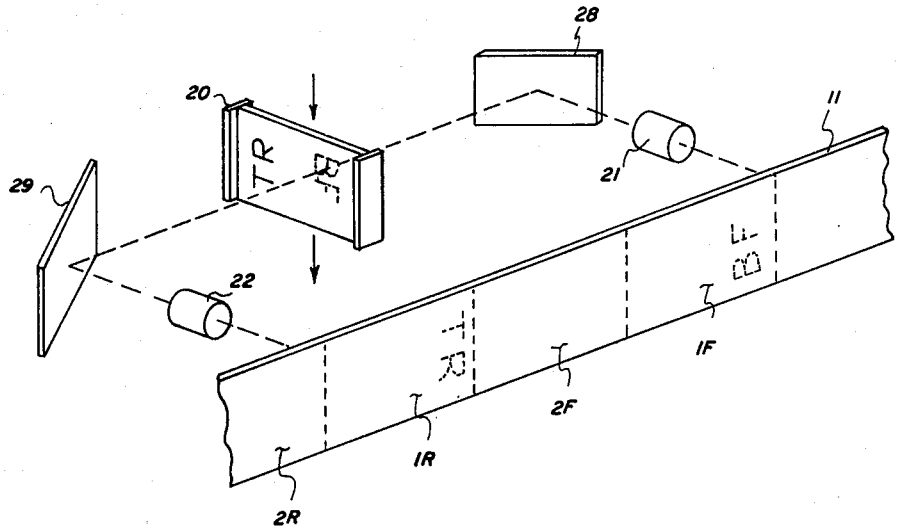
FIG. 2 is a schematic perspective view illustrating the exposure system shown in FIG. 1; and FIGS. *3a–3c* are schematic views illustrating in more detail the transfer and copy sheet turnover structure of FIG. 1.

Referring in more detail to the structure of the exposure and transfer stations and to the layout of the photoconductor belt, certain aspects of the present invention will be explained. As shown in FIGS. 1 and 2 the exposure station comprises guides 20 for supporting a duplex document to be copied in an exposure plane of lenses 21 and 22, which are each respectively positioned to image one side of the supported document upon flash illumination of that side, e.g., by Xenon flash tubes 23. A document feeder 25 is provided to position successive duplex originals seriatim in the exposure plane.

It will be noted that the image member 11 is illustrated as comprising twelve separate image sectors, designated 1-F (document 1 - Front side) to 6-R (document 6 - Rear side). It will be noted further that the front and rear side sectors for odd numbered documents (1, 3 and 5) are interspersed with the front and rear sectors for the next subsequent even numbered documents (2, 4 and 6). The pattern is for the image sector for front of the subsequent document (e.g., 2-R) to be located after the sector for the front of the preceding document (e.g., 1-F) but before the sector for the rear of the preceding document (e.g., 1-R). The purpose for this will become apparent upon description of operations at the transfer station 15; however, FIGS. 1 and 2 illustrate one means in which exposure of both sides of the original at the exposure situation can be directed onto the appropriate sectors. The front and rear side exposures of an original can be sequential or simultaneous. After exposure of document "1" onto sectors 1-F and 1-R, document "2" would be fed into the exposure station and exposed onto sectors 2-F and 2-R. The control logic activates lamps 23 to effect such exposure in predetermined timed sequence with the movement of belt 11, i.e., expose document "1", wait one sector advance and expose document "2", wait three sectors advance and expose document "3", wait one sector advance and expose document "4", etc.

As shown in FIG. 2, each optical system includes one mirror surface 28, 29 so that the latent image on the photoconductor is reverse reading and inverted (the dotted-line characters appear right reading in FIG. 2 because they are viewed from the back of the photoconductor).

After appropriate development at station 14, the image sectors successively advance to transfer station 15. Under the direction of control logic 18, a copy sheet is fed from supply 17 into transfer relation with each front image sector on the photoconductor (e.g., 1-F). After passing under transfer corona 30, the copy sheet bears the toner image 1-F on its lower surface. The upper surface of the copy sheet is then attracted (e.g., by vacuum or electrostatically) to the upwardly moving surface of endless belt transport 32. This stage of the copy sheet turnover is shown in FIG. 3*a* and it can be seen that copy sheet is moved upwardly with the belt away from the transfer zone. Upon clearing of the copy sheet from the photoconductor, transport belt 32 is moved to the position shown in FIGS. 1 and 3*c* by rotation of its support shaft 33. This rotation also positions second transport belt 34 in location to receive the next succeeding copy sheet (e.g., bearing image 2-F) as it passes from transfer relation with the photoconductor.

Referring now to FIG. 3*b*, it will be noted that midway in its rapid movement from the position shown in FIG. 3*a* to the position shown in FIG. 3*c*, the transport belt 32 reverses directions of drive and feeds its supported copy sheet downwardly. As shown this downward feed disposes the originally trailing end of the copy sheet in close proximity to the re-feed transport belt 36. This copy sheet end is attracted to belt 36 which feeds it downwardly in proper orientation and timed relation to repass under transfer corona 30 in registry with the rear side image of its respective document (e.g., 1-R). After transfer of the rear side toner image, the copy sheet passes into roller fuser 16 and the images on both surfaces are fixed.

As re-feed of the copy sheet for the image 1-R transfer is occurring, transport belt 34 rotates in the same manner as did belt 32 to transfer the copy sheet bearing image 2-F onto re-feed belt 36 for its second pass through transfer zone in registry with image sector 2-R. After re-passage of the second copy sheet, two new copy sheets are fed sequentially into the transfer station for similar manipulation to receive image sectors for documents "3" and 4. Prior to the egress of the first of said new copy sheets shaft 33 has rotated to position belts 32 and 34 in the position shown in FIG. 3*a*. The described indexing rotation of shaft 33 can be accomplished by conventional motor means (not shown) under the control of the machine control logic 18.

Thus it will be appreciated that the novel document-intersperse approach of the present invention allows duplex copying with a single transfer station and moreover without suffering a decrease in copy rate commensurate with document turnover time.

There are various alternative forms and modes for practice of the invention, including transfer copying other than electrographic, that will occur to one skilled in the art. For example, if images from separate documents were desired to be formed on front and rear sides of a single copy sheet, separate exposure platens could be provided to receive such separate documents. In applications involving electronic imaging of the photoconductor, e.g., by a laser scanner modulated with a video signal, information from various sources could be recorded on opposite sides of a copy sheet. If scanning exposure were desired rather than flash exposure, an additional copy sheet manipulation can be implemented during turnover to accommodate the difference in image orientation inherent in such exposure.

The invention has been described in detail with particular reference to certain preferred embodiments thereof, but it will be understood that variations and modifications can be effected within the spirit and scope of the invention.

What is claimed is:

1. An electrographic method for copying first and second sides of duplex originals respectively onto first and second sides of copy sheets, said method comprising:

(a) forming electrographic toner images of the sides of two successive originals on an image member in the spatial sequence: first-side/first-original, first-side/second-original, second-side/first-original, second-side/second-original; and (b) transferring the first and second original images respectively to first and second copy sheets with turnover of the first copy sheet occurring during transfer of the first-side/second-original image to the second copy sheet.

2. An electrographic method for copying successive pairs of front and rear side information respectively onto first and second sides of successive copy sheets, said method comprising:

(a) forming electrographic images of the successive pairs of information on an image member in the spatial sequence: front-side/first-pair, front-side/-second-pair, rear-side/first-pair, rear-side/second-pair; and (b) transferring the first and second pairs of images respectively to first and second copy sheets with turnover of the first copy sheet occurring during transfer of the front-side/second-pair image to the second copy sheet.

3. An improved electrographic method for copying front and rear sides of first and second duplex originals respectively onto front and rear sides of first and second copy sheets, said method comprising:

(a) forming toner images of the sides on an image member in the spatial sequence: front-side/first-original, front-side/second-original, rear-side/first-original, rear-side/second-original;

(b) transferring the front-side/first-original image to the front side of a first copy sheet;

(c) transferring the front-side/second-original image to the front side of a second copy sheet while turning over said first copy sheet to position its second side for image transfer;

(d) transferring the rear-side/first-original image to the second side of said first copy sheet while turning over said second copy sheet to position its second side for image transfer; and (e) transferring the rear-side/second-original image to the rear side of said second copy sheet.

4. An improved method for copying first and second sides of duplex originals respectively onto first and second sides of copy sheets, said method comprising:

(a) forming images of the sides of two successive originals on an image member in the spatial sequence: first-side/first-original, first-side/second-original, second-side/first-original, second-side/-second-original; and (b) transferring the first and second original images respectively to first and second copy sheets with turnover of the first copy sheet occurring during transfer of the first-side/second-original image to the second copy sheet.

5. In electrographic apparatus of the type in which electrographic images of successive pairs of front and rear side information are formed on a multi-image imaging member and transferred to corresponding sides of successive copy sheets, the improvement comprising:

(a) means for forming electrographic images of the successive pairs of information on such image member in the spatial sequence: front-side/first-pair, front-side/second-pair, rear-side/first-pair, rear-side/second-pair; and (b) means for transferring the first and second pairs of images respectively to first and second copy sheets, said transfer means including means for turning over one of said copy sheets during image transfer to the other of said copy sheets.

6. Electrographic apparatus of the type having charging, developing and transfer stations and a multi-image electrographic member movable along an operative imaging path past such stations, said apparatus further comprising:

(a) means for supporting duplex originals for exposure onto said member;

(b) means for positioning successive such originals on said supporting means;

(c) means for exposing front and rear side images of a supported original onto said image member, in a spatial relation which forms an image exposure area therebetween;

(d) means for coordinating said exposing means with movement of said image member along said path so that the images of such original sides are formed on said member in the spatial sequence: front-side/-first-original, front-side/second-original, rear-side/first-original, rear-side/second-original;

(e) means for feeding copy sheets successively into transfer relation at said transfer station with images developed at said development station;

(f) means for turning over such copy sheets after image transfer to a first side thereof and for repositioning such sheets for image transfer to the other side thereof; and (g) means for coordinating said repositioning and sheet feeding means with movement of said member so that a first-fed copy sheet receives said first-original images on opposite sides thereof and a second-fed copy sheet receives said second-original images on opposite sides thereof.

7. In electrographic apparatus of the type in which electrographic toner images of the front and rear sides of successive duplex originals are formed on a multi-image imaging member and transferred respectively to corresponding sides of successive copy sheets, the improvement comprising:

(a) means for forming toner images of the sides of two successive originals on such image member in the spatial sequence: front-side/first-original, front-side/second-original, rear-side/first-original, rear-side/second-original; and (b) means for transferring such first and second original images respectively to first and second copy sheets, said transfer means including means for turning over one of such copy sheets during image transfer to the other of such copy sheets.

8. In apparatus of the type in which transferable images of two-sided originals are formed on a multi-image imaging member and transferred to corresponding sides of copy sheets, the improvement comprising:

(a) means for forming images of the sides of two successive originals on an image member in the spatial sequence: first-side/first-original, first-side/-second-original, second-side/first-original, second-side/second-original; and (b) means for transferring the first and second original images respectively to first and second copy sheets, said transfer means including means for turning over one of said copy sheets during image transfer to the other of said copy sheets.

* * * * *